United States Patent [19]

Schoeff et al.

[11] Patent Number: 4,519,376

[45] Date of Patent: May 28, 1985

[54] FIREPLACE ASSEMBLY

[75] Inventors: Terry G. Schoeff, Andrews, Ind.; Raymond A. Hemmert, deceased, late of Huntington, Ind., by First National Bank, executor

[73] Assignee: American Standard Inc., New York, N.Y.

[21] Appl. No.: 528,194

[22] Filed: Oct. 4, 1983

Related U.S. Application Data

[62] Division of Ser. No. 252,656, Apr. 9, 1981, abandoned.

[51] Int. Cl.[3] ..... F24B 7/00

[52] U.S. Cl. ..... 126/121; 126/123; 126/83; 126/131; 126/307 R

[58] Field of Search ..... 126/62, 63, 121, 123, 126/135, 129, 143, 307 R, 83, 77, 131

[56] References Cited

U.S. PATENT DOCUMENTS

| | | | |
|---|---|---|---|
| 616,003 | 12/1898 | Mitiska | 126/77 |
| 1,640,937 | 8/1927 | Heinish | 126/121 |
| 2,270,940 | 1/1942 | Elmore | 126/121 |
| 2,396,535 | 3/1946 | Rumery | 126/121 |
| 2,703,567 | 3/1955 | Manchester et al. | 126/83 X |
| 2,743,720 | 5/1956 | Dollinger | 126/121 |
| 3,880,139 | 4/1975 | Young | 126/62 X |
| 4,074,679 | 2/1978 | Jensen | 126/121 |
| 4,185,610 | 1/1980 | Buckner | 126/121 |

FOREIGN PATENT DOCUMENTS

| | | | |
|---|---|---|---|
| 122113 | 11/1900 | Fed. Rep. of Germany | 126/77 |

*Primary Examiner*—Margaret A. Focarino

*Attorney, Agent, or Firm*—James J. Salerno, Jr.; Robert G. Crooks; John P. Sinnott

[57] ABSTRACT

A heat exchanger having an ambient air entrant opening and a heated air discharge opening which is adapted for use with, or is provided as an integral assembly for a fireplace is disclosed. The heat exchanger is in the form of a duct and includes a primary heat transfer surface for mounting in surrounding relation with the combustion chamber of the fireplace and at least one secondary heat transfer surface mounted in the duct so that the heat is transferred from the primary heat transfer surface by direct radiation to the at least one secondary heat transfer surface and from the at least one secondary heat transfer surface to the wall surface of the duct opposite the primary heat transfer surface whereby the heat transfer capacity of the heat exchanger is increased in direct proportion to the surface areas of the primary and the at least one secondary heat transfer surfaces.

6 Claims, 11 Drawing Figures

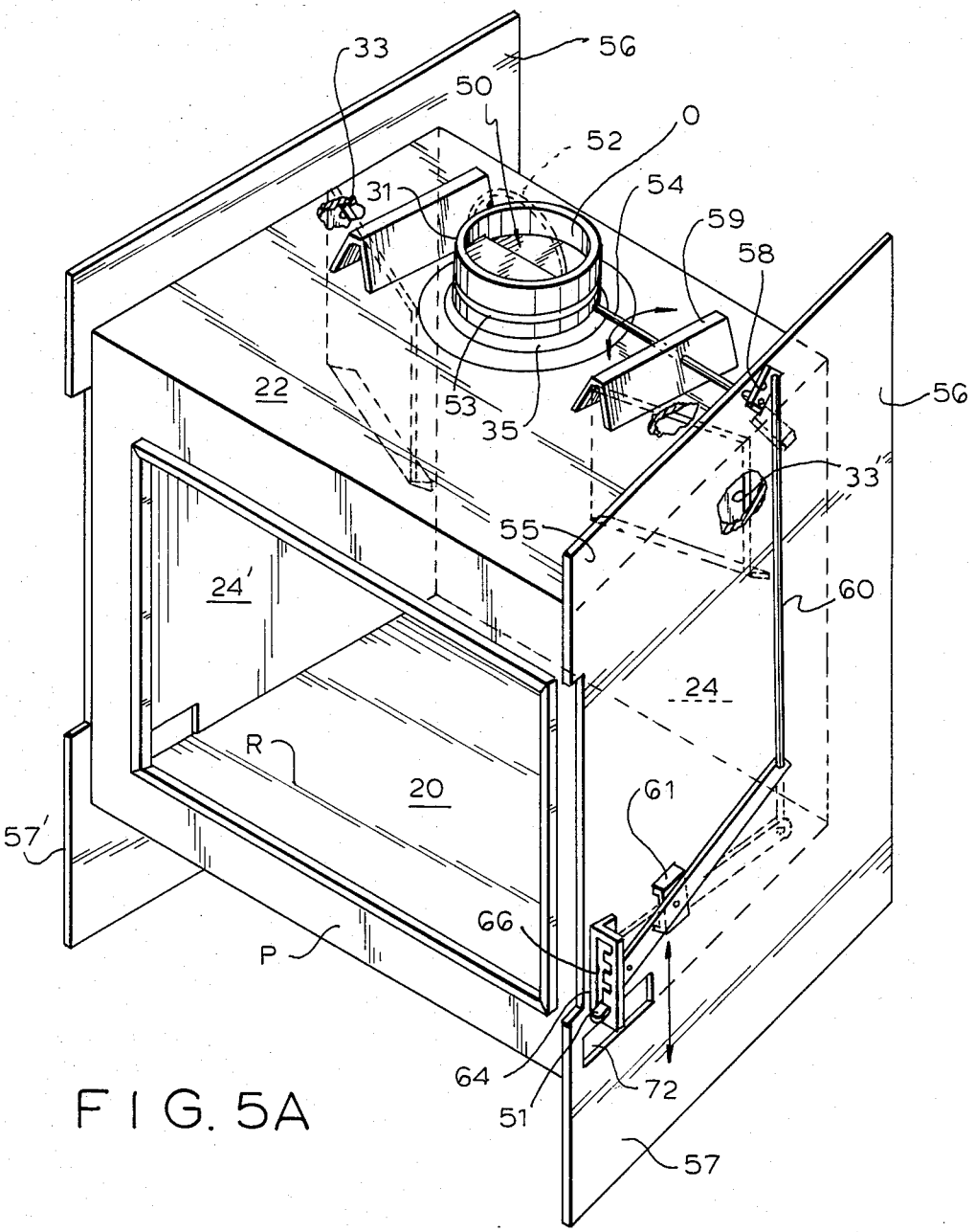
FIG. 5A
FIG. 5B
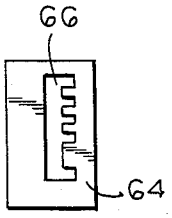

FIREPLACE ASSEMBLY

This application is a division of application Ser. No. 252,656, filed 4/9/81, now abandoned.

BACKGROUND OF THE INVENTION

1. Field of the Invention

This invention relates to a heat exchanger for use with a fireplace assembly to increase the heat transfer capacity of the fireplace assembly without increasing the flow of ambient air through the heat exchanger or the size of the heat exchanger.

2. Description of the Prior Art

A heat exchanger for use with a fireplace or a fireplace incorporating a heat exchanger is known, for example, as taught in U.S. Pat. No. 4,185,612 of Briner and Hempel. The heat circulating fireplace assembly disclosed includes a heat exchanger having a generally increased surface area to increase the heat transfer capacity of the heat exchanger.

Other heat exchangers of various designs are also employed such as is disclosed in U.S. Pat. Nos. 3,880,141, 3,896,785, 3,995,611, 3,965,886, 4,117,827, 4,008,707 and Australian Specification No. 211,350—9/54. All of these fireplace assemblies have heat exchangers and ducts for conducting air in and around the combustion chamber, however, none of these heat exchangers or ducts provides at least one secondary heat transfer surface as a means for increasing the heat transfer capacity of the heat exchanger.

SUMMARY OF THE INVENTION

It is the object of the invention to provide a heat exchanger having at least one secondary heat transfer surface for increasing the heat transfer capacity of a heat exchanger.

It is another object of the invention to provide a heat exchanger for use with the fireplace in which a heat exchanger is mounted in surrounding relation with the combustion chamber so that substantially all of the primary heat transfer surfaces of the heat exchanger are in heat transfer relation with the combustion chamber.

Still another object of the invention is to provide a fireplace having a heat exchanger which is in the form of a duct and is mounted in surrounding relation with the combustion chamber, one wall of the duct being the primary heat transfer surface and being in heat exchange relation with the combustion chamber, the heat exchanger having at least a secondary heat transfer surface mounted in the duct and positioned substantially parallel to the primary heat transfer surface to provide means for increasing the heat transfer capacity of the heat exchanger to heat the ambient air passing therethrough without increasing the fuel heat input of the fireplace.

It is another object of the invention to provide a prefabricated fireplace assembly having a heat exchanger which is in the form of a duct and is mounted in surrounding relation with the combustion chamber, one wall of the duct being at least one wall of the combustion chamber and forming at least one wall of the primary heat transfer surface of the heat exchanger, the heat exchanger having at least one secondary heat transfer surface mounted in the duct and positioned substantially parallel to the primary heat transfer surface to provide means for increasing the heat transfer capacity of the heat exchanger without increasing the BTU input of the fireplace.

It is another object of the invention to provide a heat exchanger having ambient air control means for conducting air into the heat exchanger by either a natural convection mode or by a forced air convection mode.

A further object of the invention is to provide a heat exchanger for use with a fireplace which is made of light-weight component parts and which is relatively easy to manufacture and assemble.

Another aspect of the invention is to provide a combustion air control assembly capable of controlling combustion air entering the combustion chamber.

Another object of the invention is to provide a prefabricated fireplace assembly in which the combustion chamber includes a flat top wall instead of the conventional domed section.

Another aspect of the invention is to provide an improved flue assembly mounted to the flat top wall of the combustion chamber which reduces the resistance or pressure drop of the combustion products exiting the combustion chamber through the flue.

Another aspect of the invention is to provide a flue damper assembly which is operable between open and closed positions and variable there between and includes operating means positioned remote from the combustion chamber.

The invention generally contemplates providing a heat exchanger having an ambient air entrant opening and a heated air discharge opening which is adapted for use with, or is provided as an integral assembly of a fireplace. The heat exchanger is in the form of a duct and includes a primary heat transfer surface for mounting in surrounding relation with the combustion chamber of the fireplace and at least one secondary heat transfer surface mounted in the duct so that heat is transferred from the primary heat transfer surface by direct radiation to the at least one secondary heat transfer surface and from the at least one secondary heat transfer surface to the wall surface of the duct opposite the primary heat transfer surface whereby the heat transfer capacity of the heat exchanger is increased in direct proportion to the surface areas of the primary and the at least one secondary heat transfer surfaces.

BRIEF DESCRIPTION OF THE DRAWINGS

FIG. 5A is an isometric view with sections of the fireplace broken away which illustrates the flue damper assembly mounted in operable position therein and the positioning of the diverter plates in the combustion chamber;

FIG. 5B is an elevational view of the latch means for locking the damper in a set position;

DESCRIPTION OF THE PREFERRED EMBODIMENT

Figure 1:
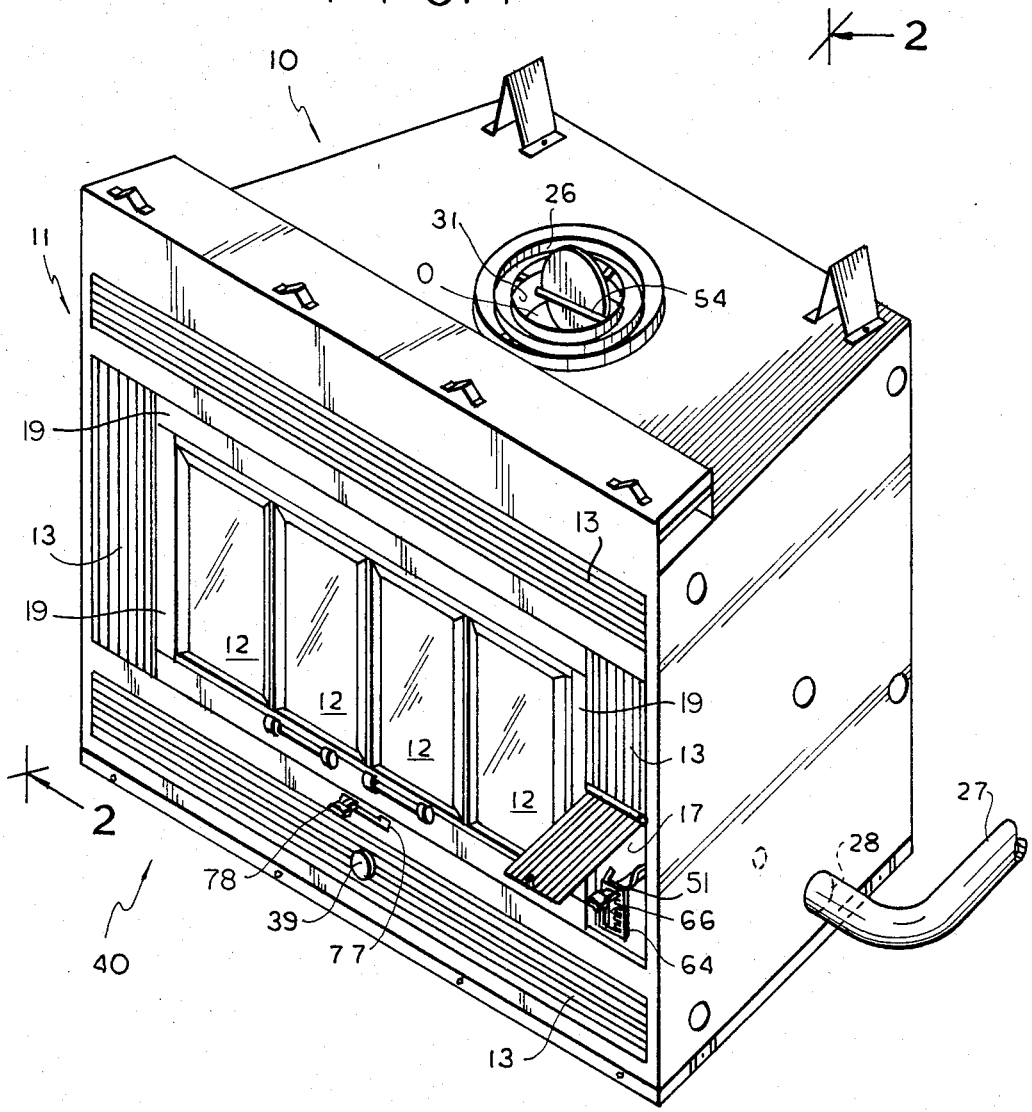
FIG. 1 is an isometric view of a fireplace assembly embodying the present invention.

The present invention is illustrated in the accompanying figures wherein similar parts are indicated by the same reference numeral throughout the several views and where pairs or parts are used, the parts are referenced by prime of the referenced numeral.

Figure 2:
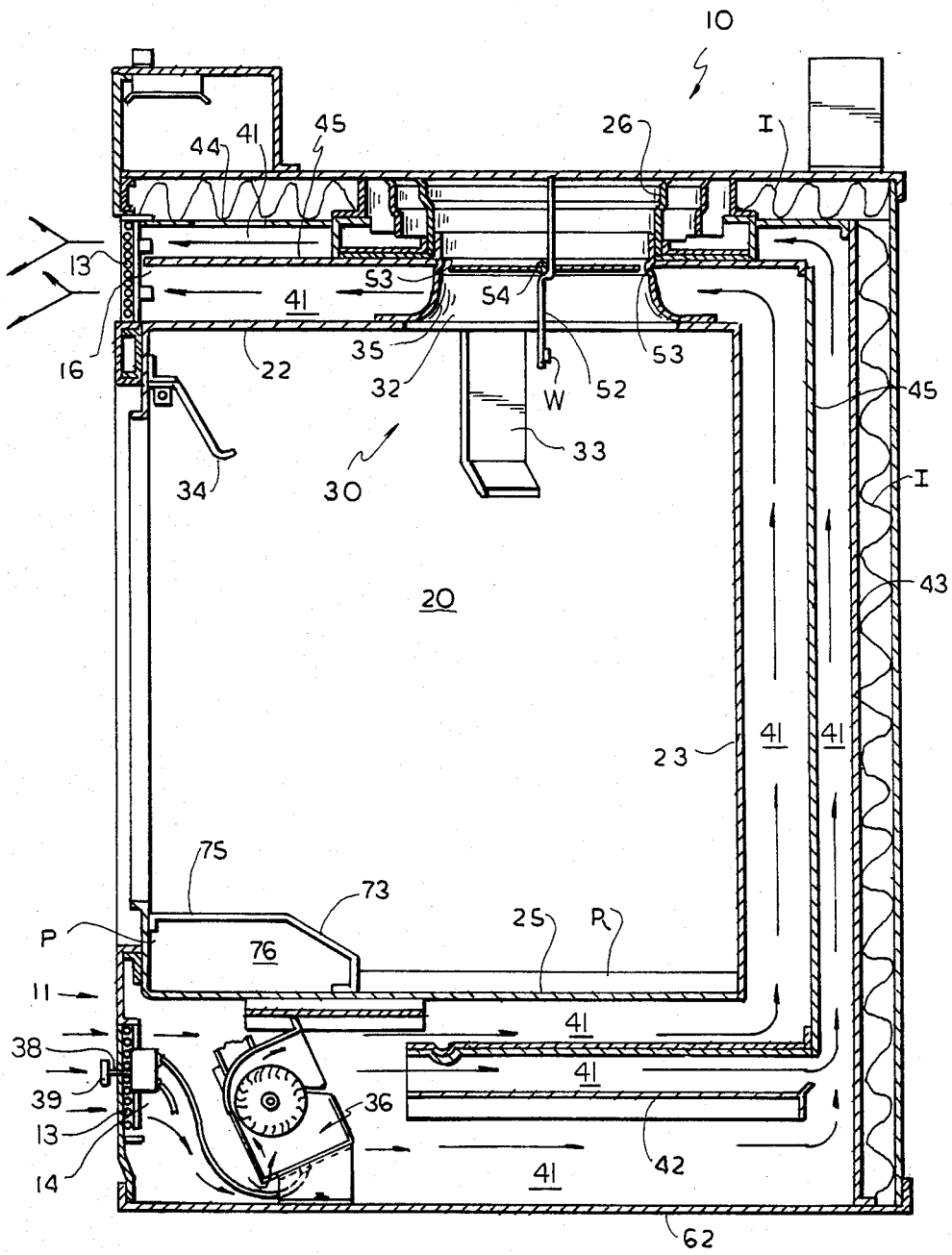
FIG. 2 is a sectional elevational view of the fireplace taken along the line 2—2 of FIG. 1; with the glass door assembly removed for clarity.

In the drawings, fireplace assembly 10 is illustrated in FIGS. 1 and 2. A front closure assembly 11 encloses the combustion chamber opening 21 by use of glass doors 12 and grills 13 for covering the air entrant openings 14, 15, 15', and heated air discharge openings 16, 17, 17' of the heat exchanger means 40, discussed hereinafter in relation to the combustion chamber 20. Grill 13 is hingedly mounted to gain access to handle 51 for manipulating flue damper assembly 50 which is operably mounted in air entrant opening 15, and will be discussed hereinafter with relation to FIGS. 5A and 5B. Fireplace assembly 10 includes a flue assembly 30 mounted in fixed position on top wall 22 of combustion chamber 20 and includes a transition section 26 for coupling to a thermosiphoning chimney assembly, not shown. An outside air duct assembly 27, 27' not shown, is mounted to each side wall 18, 18' of fireplace 10 at opening 28, 28' and is coupled to the combustion air control assembly 70 which will be discussed hereinafter in relation to FIGS. 6, 7, 8, 9 and 10.

Referring principally to FIG. 2, fireplace assembly 10 is illustrated in sectional assembly and comprises a combustion chamber 20 which includes a hearth 25, back or rear wall 23, top wall 22, and side walls 24, 24'. Mounted on hearth 25 is a refractory "R" which can be in the form of a slab as is presently used in most prebuilt fireplaces, to support the weight of the grate and the fuel for combustion. Glass doors 12 are mounted on frame 19 which is mounted to fireplace 10 in surrounding relation to combustion chamber opening 21.

Fireplace assembly 10, as illustrated in FIGS. 1 and 2, utilize a combustion chamber design with a flat top rather than a conventional domed section used in prebuilt fireplaces. One aspect of applicants' design includes a flue assembly which permits the use of a flat top design so that the overall height of the fireplace is reduced, prevents spillage of combustion gases into the room and leads to economies both in manufacture and installation. Top wall 22 of combustion chamber 20 has flue 31 mounted on its upper surface in surrounding relation with flue outlet opening 32 formed therein and is positioned equidistant between side walls 24, 24' but is offset rearwardly along the center line of the combustion chamber. Flue assembly 30 includes flue 31, diverter plates 33, 33' and screen rail 34. Transition section 26 is mounted to flue 31 to provide a connection between the chimney, not shown, and combustion chamber 20 as illustrated in FIG. 2. A pair of diverter plates 33, 33' are mounted in combustion chamber 20 and are shaped in the form of an "L". The angle formed by the two sides of the "L" is approximately 45 degrees, the lower leg of which adds structural stability thereto. Diverter plates 33, 33' are mounted perpendicular to top wall 22 and side wall 24, 24' and in offset relation to rear wall 23 with the free end of diverter plate 33, 33' positioned adjacent flue opening 32 as illustrated in dotted lines and in the broken away sections in FIG. 5A. Also, provided in combustion chamber 20 is screen rail 34 which functions as an air brake to divert the flow of frontal air and flue gasses so that the flow is in a direction towards the flue outlet 32 as shown in the direction of the arrows in FIG. 10. Screen rail 34 is mounted to the front wall of the combustion chamber adjacent top wall 22 as seen in FIG. 2. Flue 31 is shaped so that the diameter of the flue outlet opening 32 is reduced in cross-sectional area providing an inwardly formed arcuate base 35. The inwardly curved surface or base section 35 forms a converging nozzle. Diverter plates 33, 33' are proportional in height to the diameter of the flue, are mounted perpendicular to side walls 24, 24', top wall 22 and are positioned relative to flue opening 32 so that the flue draft draws the combustion gases up the chimney. The screen rail or air brake 34 also provides means for directing the combustion gases inwardly toward flue opening 32 where the flue draft draws the gases up the chimney. Both diverter plates 33, 33' and screen rail 34 reduce turbulence to prevent combustion gas separation which prevents a portion thereof from spilling into the room. Flue assembly 30 reduces the resistance or pressure drop of the combustion products exiting combustion chamber 20 through flue outlet 32 so that the available outlet draft for combustion equals or exceeds the resistance or pressure drop and prevents spillage of combustion gases and smoke out of front opening 21 of combustion chamber 20 and permits the use of a combustion chamber having a flat top wall design.

Figure 3:
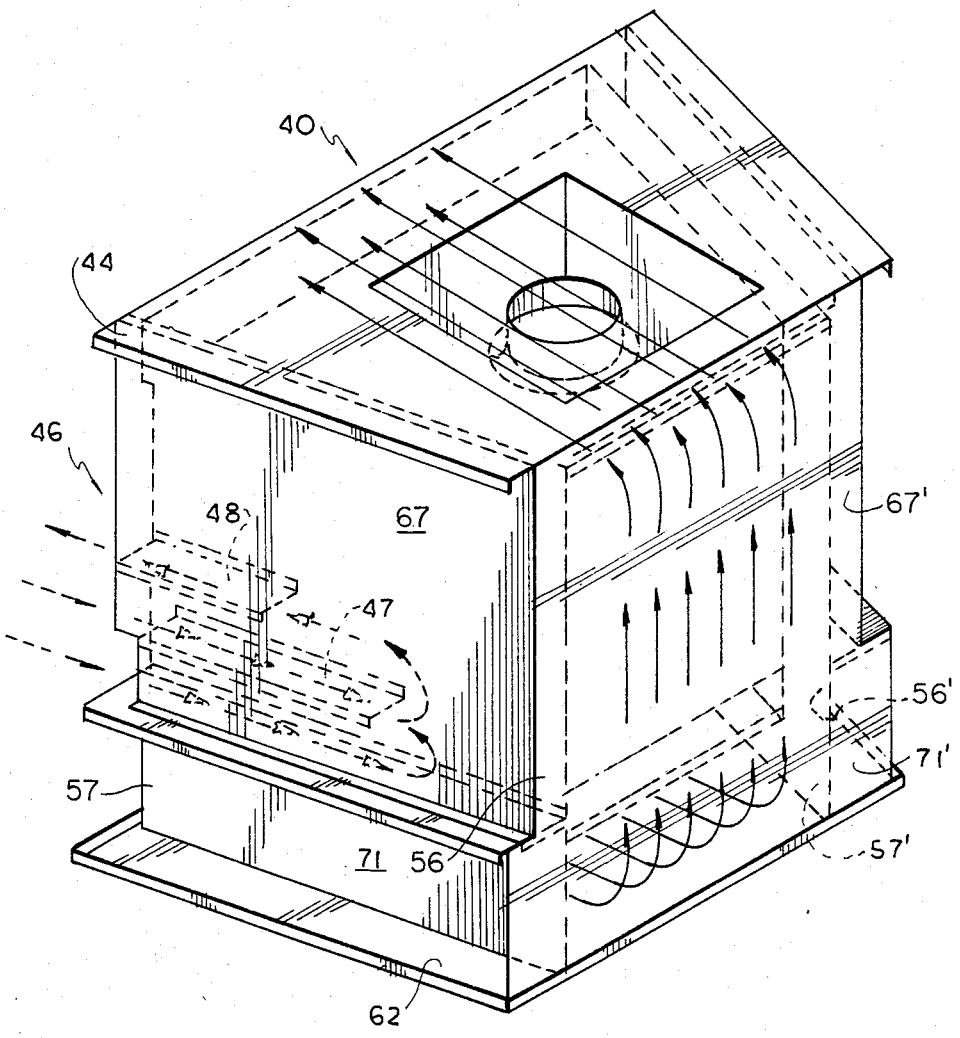
FIG. 3 is an isometric view of the fireplace as seen from the rear, one side, and the top, with the exterior wall surfaces removed to illustrate the flow of ambient air being conducted through the heat exchanger means surrounding the combustion chamber of the fireplace.
Figure 4:
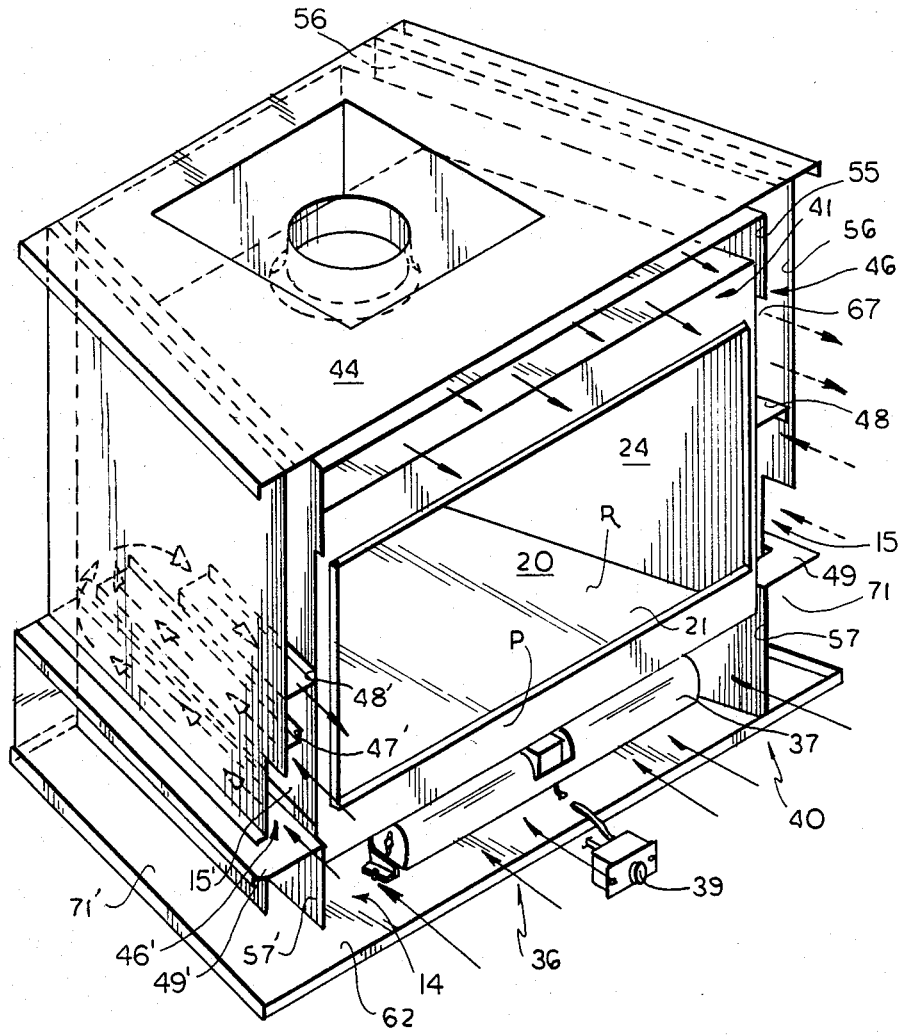
FIG. 4 is a view similar to FIG. 3 but as viewed from the front, one side and the top, with the exterior wall surfaces removed to illustrate the flow of ambient air passing into and out of the heat exchanger means surrounding the combustion chamber of the fireplace.

Heat exchanger means 40 is shown in isometric view in FIGS. 3 and 4. A main or principal heat exchanger 41 is illustrated in vertical section in FIG. 2 with arrows indicating the flow of air to be heated and discharged into the room. Heat exchanger 41 includes a primary heat transfer surface made up of the top wall 22, rear wall 23, and the hearth 25 of the combustion chamber. Heat exchanger 41 is formed having a rectangular cross-section and is U-shaped so that it fits in surrounding relation to combustion chamber 20 of fireplace 10. The outside wall or surface of heat exchanger 41 includes bottom wall 62, vertical wall 43, and horizontal wall 44. The vertical side walls of heat exchanger 41 are formed by top, rear and bottom extensions of side walls 24, 24' of the combustion chamber 20. Side walls 24, 24' extend above top wall 22 to form the vertical side walls 55, 55' of the top portion of the heat exchanger 41. Side wall 24, 24' extends downwardly below hearth 25 to form vertical side walls 57, 57' of heat exchanger 41 as illustrated in FIG. 4. Side walls 24, 24' extend rearwardly to form vertical side walls 56, 56' of the rear portion of heat exchanger 41. A secondary heat transfer surface 45 is mounted between and is parallel to outer walls 62, 43, 44 of heat exchanger 41 and the primary heat transfer surfaces 22, 23, 25. It will be readily apparent that when a heat exchanger of the type illustrated herein is used as a fireplace insert, the primary heat transfer surface, instead of forming part of the combustion chamber would be a separate metal surface which when mounted in position in a combustion chamber of the fireplace, would be positioned adjacent the hearth, rear wall and top wall of the combustion chamber and will be in heat transfer relation with the source of heat, i.e., the fire.

Figure 6:
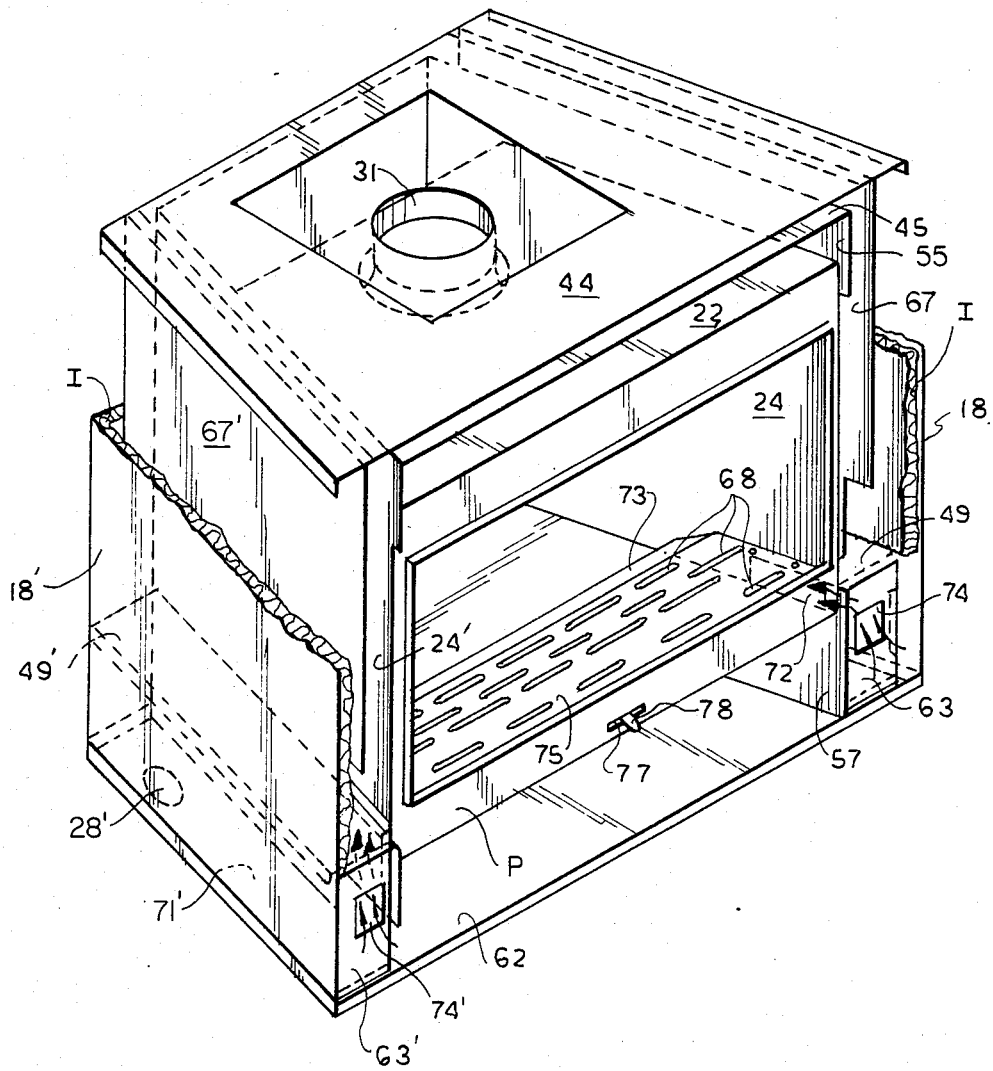
FIG. 6 is an isometric view showing the path of ambient air entering the fireplace through the combustion air control assembly and into the combustion chamber of the fireplace.
Figure 7:
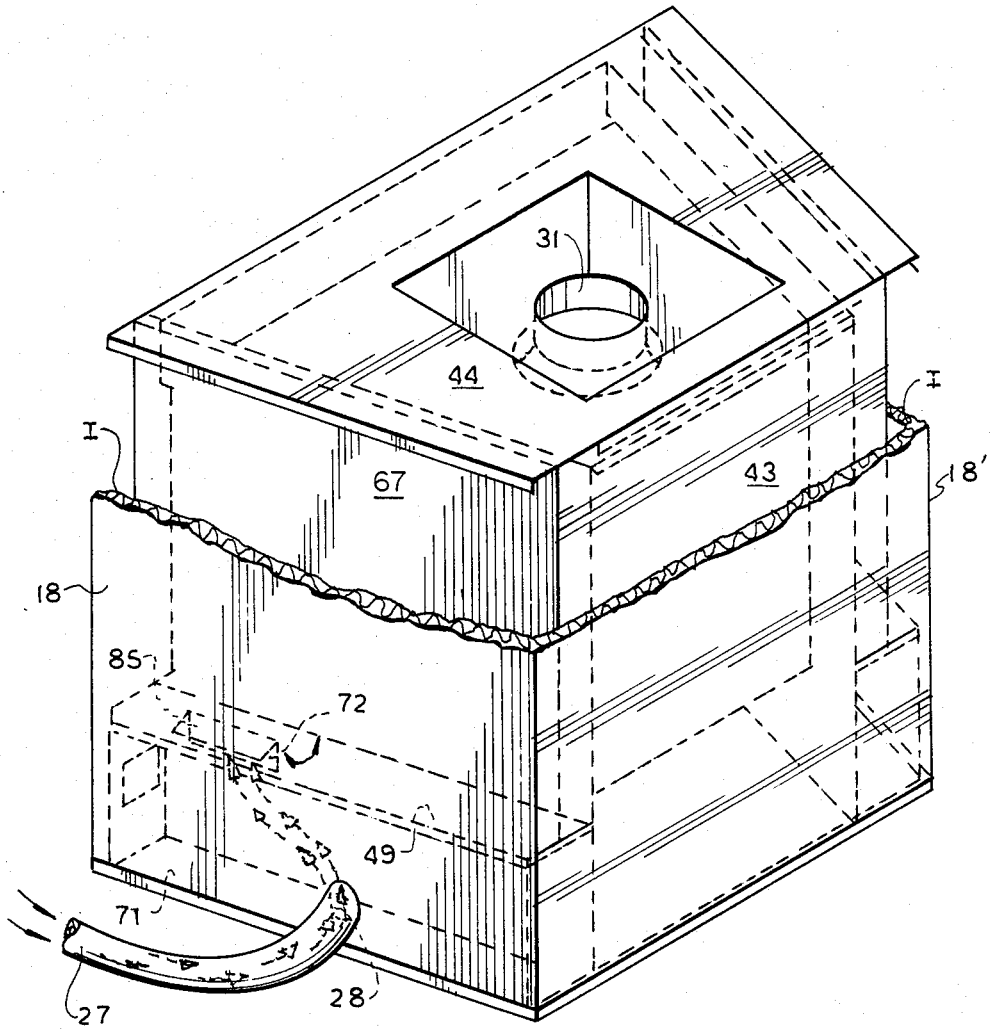
FIG. 7 is a view similar to FIG. 6 except that outside combustion air is illustrated entering through the combustion air control assembly and into the combustion chamber of the fireplace.

Auxiliary heat exchanger 46, 46', illustrated in FIGS. 3, 4 and 6, are mounted in parallel relation to side walls 24, 24' of combustion chamber 20. Auxiliary heat exchanger 46, 46' includes an outer wall 18, 18' which is spaced from and is parallel to side walls 24, 24'. Secondary heat transfer surface 67, 67' is positioned between side wall 24, 24', outer wall 18, 18' in substantial parallel relation there between. Interposed between walls 24, 24' and 67, 67' are baffles 47, 48 and 47' 48' which are mounted in parallel spaced relation to each other and perpendicular to side walls 24, 24' and 67, 67'. Baffles 47, 47' are of greater length than baffles 48, 48' and are positioned below baffles 48, 48'. The spaced and staggered relation of baffles 47, 48 and 47' 48' permits cold or ambient air to enter auxiliary heat exchanger 46, 46' through the bottom region and exit through the top region as illustrated in the direction of the arrows in FIG. 4. The circulation of room air through the auxiliary heat exchanger is preferably by natural convection.

Figure 10:
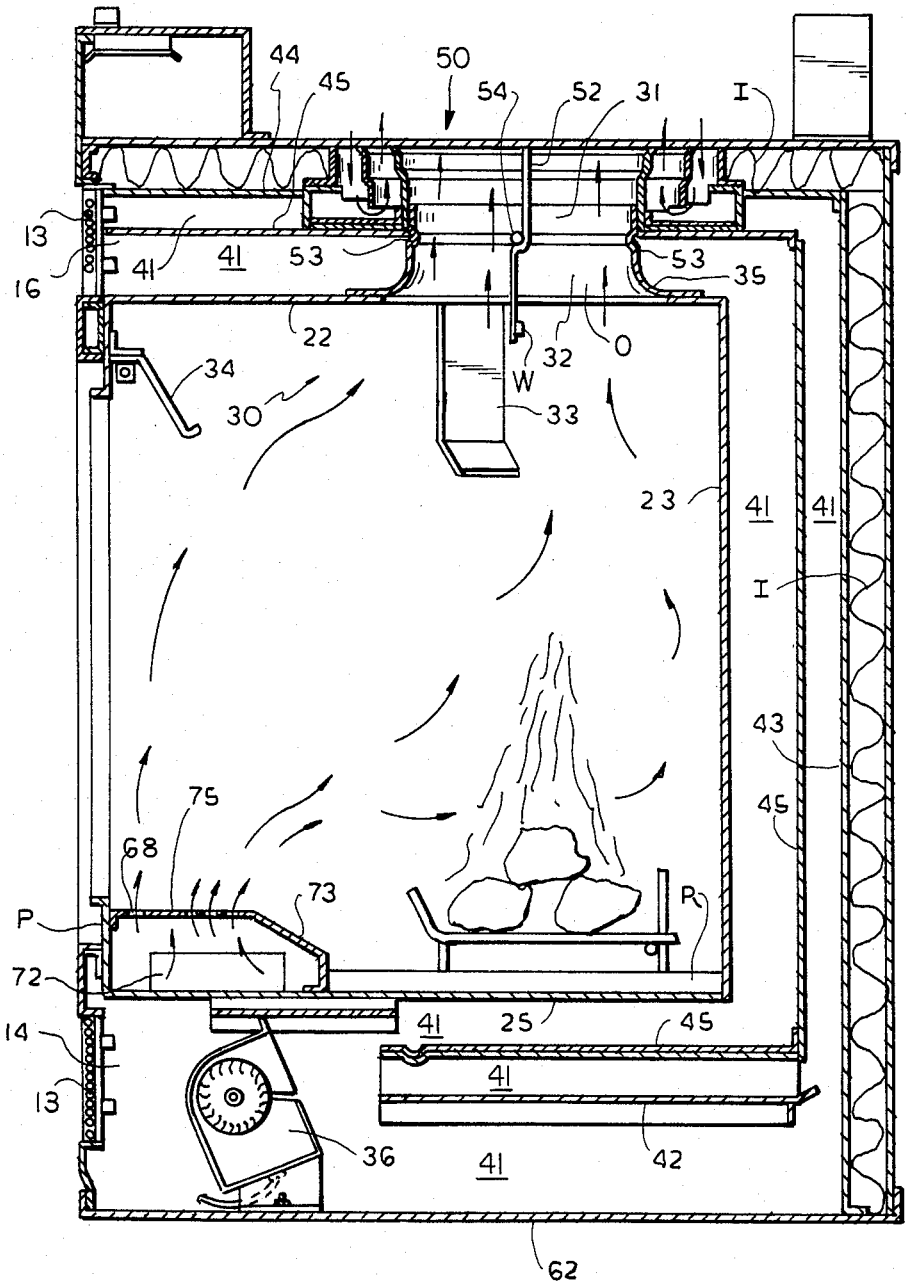
FIG. 10 is a sectional elevational view of the fireplace illustrating the path of combustion air entering and combustion gasses passing through the combustion chamber and exiting through the flue.

Also illustrated in FIGS. 2, 4 and 10 is fan assembly 36. Heat exchanger 41, as indicated in connection with FIG. 2, includes a fan assembly 36 mounted in the air entrant opening 14 and when operative provides a force air convention mode for air to be heated that is forced through heat exchanger 41. Air to be heated passes on either side of the secondary heat transfer surfaces 42, 45 as illustrated by the direction of the arrows in FIG. 2. It has been found that when fan 36 is operative, it is not necessary to isolate all of the air entering the heat exchanger so that the air passes through the fan assembly first before entering the heat exchanger. An actual increase in heat exchanger efficiency has been obtained by operating fan assembly 36. The fan is of the variable speed type and is controlled by a switch electrically connected to the fan motor and is operative through shaft 38 when knob 39, shown in FIG. 1. is rotated.

Combustion air control assembly 70 is best illustrated in FIGS. 6–10. It provides means for controlling the amount of combustion air entering combustion chamber 20. At the time of installing fireplace assembly 10, an outside air source may be coupled to combustion air control assembly 70 so that only outside air is introduced into the combustion chamber. This is illustrated in FIG. 1 in which outside air duct 27, 27' is coupled between an outside air supply not shown and combustion air control assembly 70 through opening knockout 28, 28' in outside panel 18, 18'. If only room or ambient air is to be used, then a rectangular or square removeable cover is removed from the front panel of fireplace assembly 10 to provide air entrant openings 74, 74' while openings 28, 28' remain closed with its circular knockout in place. In referring to FIG. 8, which illustrates combustion air control assembly 70, the mode of operation will be described so that only ambient or room air enters combustion chamber 20. It should be understood that combustion air control assembly 70 operates in an identical manner when outside air is used for the source of combustion air and is shown by the direction of the arrows in FIG. 7. Combustion air control assembly 70 includes a duct or plenum 71, 71' which is positioned parallel to side walls 24, 24' and mounted along the base panel or bottom wall 62 of fireplace assembly 10. Duct 71, 71' is bounded by base 62 of auxiliary heat exchanger 46, two side walls 57, 18 and 57', 18', rear wall 43, and front wall 63, 63'. The front of combustion chamber 20, as shown in FIG. 6, includes lower panel P which extends across the front of the fireplace and is formed integral with hearth 25. Lower panel P forms the front vertical wall of combustion air duct 76 and includes a horizontal slot 77 for insertion of handle 78 of combustion air control assembly 70. Combustion air duct 76 includes an integreally formed removeable cover having a side 73 and top wall 75. Top wall 75 includes a plurality of parallel and staggered rows of slots 68. The other side of top wall 75 abuts against lower panel P, see FIG. 2. The side edges of cover are mounted against side walls 24, 24' by fasteners 79, see FIG. 6. An opening 72, 72' is formed in side wall 24, 24' which communicates with the respective plenums of ducts 76 and 71, 71'.

Figure 8:
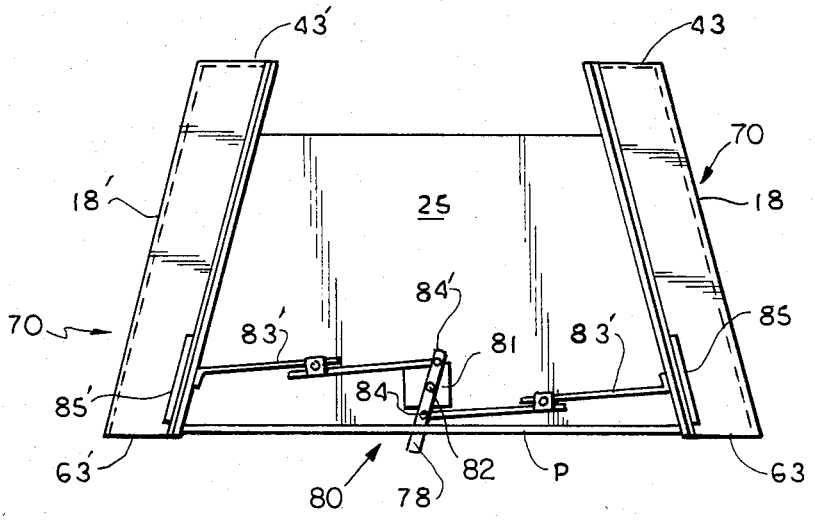
FIG. 8 is a top plan view of the combustion air control assembly.
Figure 9:
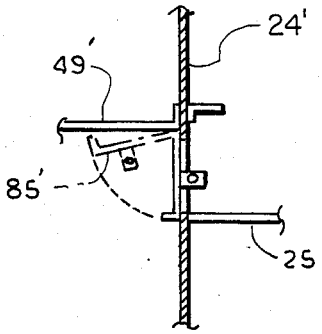
FIG. 9 illustrates the opening and closing of one of the damper blades of the combustion air control assembly shown in FIG. 8.

Combustion air control damper assembly 80 includes plate or bushing 81 having a pin or axle 82 mounted in plate 81 and shiftably mounting handle 78 thereon. A pair of adjustable damper operating arms 83, 83' is pivotally mounted to damper handle 78 through openings 84, 84' and to damper blades 85, 85' which are hingedly connected to walls 49, 49' and are shifted from a closed position to an open position when operating handle 78 is shifted to the right as shown in FIG. 8. Thus, combustion air control assembly 70 through damper assembly 80, can be shifted from a fully closed position to a fully open position to control the air entering the combustion chamber. Glass doors 12 need not be opened and preferably remain closed so that the most efficient use of the fuel can be achieved. The combustion gases and air are depicted rising toward flue opening 32 by the direction of the arrows shown in FIG. 10. Combustion air entering duct 76 passes through slots 68, a portion thereof will form a cooling air curtain which rises vertically adjacent to glass doors 12, past screen rail 34 which deflects the air and some of the combustion gases into flue opening 32. Still other portions of combustion air pass through slots 68, which are positioned closest to the burning fuel and is swept into the burning zone, toward the rear wall 23 of combustion chamber 20, past diverter plates 33, 33' and into flue opening 32.

In FIGS. 1, 5A, and 5B, flue damper assembly 50 is shown in full assembly. Flue damper assembly 50 is mounted so that all of the operative parts of the assembly lie outside combustion chamber 20. A rim or bead 53 is inwardly formed in flue 31 to provide a seat for flue damper 52 to nest on. Flue damper 52 is rotatably mounted by rod 54 which is fixedly mounted at one end to flue damper 52 and rotatably mounted at its other end by crank linkage 58. Rod 54 is positioned above heat exchanger wall 22 and passes through an inverted V-formed metal member 59 which acts as a brace to hold rod 54 in alignment with flue damper opening "O" to facilitate rotation thereof. A vertical rod 60 is rotatably mounted at one end to crank linkage 58 and pivotally mounted at the other end to horizontal rod or handle 51. Vertical rod 60 and handle 51 are positioned within auxiliary heat exchanger 46 so that cool or room air maintains handle 51 at a temperature comfortable to one's grasp since the entire damper assembly is not contacted by hot combustion gases in combustion chamber 20 nor is it contacted by heated air discharged from heat exchanger 41, 46. Also, hinged grille 13 covers the outer end of handle 51 so that it is not visible. Handle 51 pivots on bearing plate 61 which is mounted on side wall 24 so that handle 51, when shifted vertically as indicated by the direction of the arrows in FIG. 5A, is captured by latch 64. Rod 60 will shift in a vertical direction so that crank linkage 58 will be caused to rotate, which rotates rod 54 and shifts flue damper 52 from an open to a closed position, as indicated by the dotted lines in FIG. 5A. Should flue damper 52 become disengaged from rod 54, weight "W" wil cause flue damper blade 52 to drop to a vertical position about rod 54 so that flue 31 will be in its opened position. In FIG. 5B, latch member 64 is mounted to side wall 24 and is provided with a plurality of vertically aligned notches 66 so that handle 51 can be positioned in any one of the notches to regulate the degree of opening or closing of flue damper 52.

In operation, when fuel is burned in fireplace assembly 10, as depicted in FIG. 10, the hot combustion gases heat primary heat transfer surfaces 22, 23, 25 and 24, 24' by either direct contact of the gases on its surfaces or by direct radiation of heat energy from the burning fuel. Air entering the primary heat exchanger 41 through air entrant opening 14 passes through fan 36 and also around fan 36 into heat exchanger 41 where the air is divided. One portion or segment of air to be heated passes between the primary heat transfer surfaces 22, 23, and 25 and the secondary heat transfer surfaces 42, 45. Another portion passes between secondary heat transfer surfaces 42, 45, and outer walls 44, 43, and 62. The secondary heat transfer surface is heated by direct radiation from primary heat transfer surfaces 22, 23, and 25 which in turn heats the air therebetween. Thereafter, the heated secondary heat transfer surface heats outer walls 44, 43, and 62 which in turn transfer heat energy to the air passing therebetween. Simultaneously, as air is entering primary heat exchanger 41, room air enters the bottom region of auxiliary heat exchanger 46, 46' passing through the upper region of auxiliary heat exchanger 46, 46' and out into the room. Thus heat exchanger means 40 of fireplace assembly 10 utilizes all of the heated surfaces of combustion chamber 20 to heat ambient air and return it to the room as heated air, thereby recovering from the burning fuel substantial quantities of heat energy which normally would be lost through the flue. Also, a blanket of insulation I is housed by outer casing 18, 18', outer rear and top panels as shown in FIGS. 2, 6. The insulation maintains the heat energy in heat exchanger means 40. The insulation also maintains safe operating temperatures on the exterior surfaces of fireplace assembly 10.

We claim:

1. A fireplace assembly having a combustion chamber including an open front end, a hearth, a rear wall, left and right side walls, a top wall substantially parallel to said hearth, a flue outlet opening in said top wall and a flue assembly; said flue assembly comprising:

a flue operatively mounted to said flue outlet opening and means mounted in said combustion chamber for diverting flow of combustion air and gases toward said flue outlet opening to reduce the pressure drop of the combustion air and gases exiting said combustion chamber; said flow diverting means including a pair of L-shaped, generally rectangular diverter plates mounted in said combustion chamber and being symmetrically arranged with respect to said flue outlet opening, one end and an adjacent side of each diverter plate being, respectively, positioned in abutting relation to at least a side wall and said top wall of said combustion chamber, said L-shaped end extending toward and terminating adjacent said flue outlet opening; and said flue including an inwardly curved base defining a converging nozzle whereby the velocity and turbulence of the combustion air and gases are reduced and are diverted toward said flue outlet opening to prevent spillage of smoke and other combustion air and gases into the room.

2. The fireplace assembly of claim 1 wherein said flue is generally cylindrically shaped having an open top end for coupling to a chimney and an open lower end having a converging nozzle mounted to said flue outlet opening.

3. A fireplace assembly having a combustion chamber including an open front end, a hearth, a rear wall, left and right side walls, a flat top wall and a flue outlet opening in said top wall, a flue assembly mounted thereto, and a heat exchanger means positioned in surrounding relation to at least said hearth, rear wall and said top wall of said combustion chamber and mounted in heat exchange relation therewith; said flue assembly comprising:

a flue operatively mounted to said flue outlet opening and extending vertically from said top wall for coupling to a chimney, said flue having an inwardly curved base defining a converging nozzle so that the cross-sectional area of the flue outlet opening is reduced;

means for diverting flow and combustion air and gases towards said flue outlet opening to reduce the pressure drop of combustion air and gases exiting from said combustion chamber; and said flow diverting means including a pair of L-shaped, generally rectangular diverter plates mounted in said combustion chamber and being symmetrically arranged with respect to said flue outlet opening, one end and an adjacent side of each diverter plate being, respectively, positioned in abutting relation to at least one of said side walls and said top wall of said combustion chamber, said L-shaped end having an obliquely formed leg extending toward and terminating adjacent said flue outlet opening whereby the velocity and turbulence of combustion gases and air are reduced and are diverted toward the flue outlet opening to prevent spillage of smoke and other combustion products into the room.

4. A fireplace assembly, the combination comprising:

a combustion chamber having an open front end, a hearth, a rear wall, left and right side walls, a flat top wall substantially parallel to said hearth and an off-set flue outlet opening in said top wall positioned rearwardly of said combustion chamber along its transverse axis;

a heat exchanger means at least partially surrounding said combustion chamber and mounted in heat transfer relation thereto;

a flue operatively mounted to said flue outlet opening and means for diverting flow of combustion air and gases toward said flue outlet opening to reduce the pressure drop of the combustion air and gases exiting said combustion chamber and flow diverting means including a pair of L-shaped, generally rectangular diverter plates mounted in said combustion chamber and being symmetrically arranged with respect to said flue output opening, one end and an adjacent side of each diverter plate being, respectively, positioned in abutting relation to at least a side wall and said top wall of said combustion chamber, said L-shaped end having an obliquely formed leg extending toward and terminating adjacent said flue outlet opening; and said flue including an inwardly curved base defining a converging nozzle whereby the velocity and turbulence of the combustion air and gases are reduced and are diverted toward said flue outlet opening to prevent spillage of smoke and other combustion air and gases into the room.

5. A flue assembly adapted to be mounted to a combustion chamber of a fireplace, said combustion chamber including a flat top wall having a flue outlet opening therein, said flue assembly comprising:

a flue having an open top end for coupling to a chimney and an open lower end for coupling to said flue outlet opening and means mounted in said combustion chamber for reducing the pressure drop of the combustion air and gases and diverting the flow thereof toward said flue outlet opening of said combustion chamber;

said flow diverting means including a pair of L-shaped generally rectangular diverter plates mounted in said combustion chamber and symmetrically arranged with respect to said flue outlet opening, one end and an adjacent side of each diverter plate, respectively, positioned in abutting relation to at least a side wall and said top wall of said combustion chamber, said L-shaped end having an obliquely formed leg extending toward and terminating adjacent said flue outlet opening; and said flue including an inwardly curved base defining a converging nozzle at its lower end, whereby the velocity and turbulence of the combustion air and gases are reduced and are diverted toward said flue outlet opening to prevent spillage of smoke and other combustion air and gases into the room.

6. The flue assembly of claim 5 wherein said flue is in the form of a cylinder having its open lower end in the form of a converging nozzle.

* * * * *